US005317951A

United States Patent [19]

Reynolds

[11] Patent Number: 5,317,951

[45] Date of Patent: Jun. 7, 1994

[54] CARTRIDGE NON-RAMPING FEED MECHANISM FOR FIREARMS

[75] Inventor: George L. Reynolds, Altona, Ill.

[73] Assignee: Aerojet-General Corp., Ordinance Div., Downey, Calif.

[21] Appl. No.: 980,355

[22] Filed: Nov. 23, 1992

[51] Int. Cl.[5] ..... F41A 5/04

[52] U.S. Cl. ..... 89/160; 89/163

[58] Field of Search ..... 42/10, 11, 12, 15, 39.5; 89/33.03, 33.05, 155, 160, 161, 163, 197

[56] References Cited

U.S. PATENT DOCUMENTS 2,865,255 12/1958 Marsh ..... 89/163

FOREIGN PATENT DOCUMENTS 3700114 7/1988 Fed. Rep. of Germany ..... 89/161

OTHER PUBLICATIONS

Smith et al., The Book of Rifles, 1948, pp. 590–591.

*Primary Examiner*—Stephen C. Bentley
*Attorney, Agent, or Firm*—Robert O. Richardson

[57] ABSTRACT

A cartridge soft feed mechanism for presenting the cartridge to the chamber of a gun in such a way that the axis of the cartridge experiences no lateral or angular movement during chambering. The cartridge is telescoped into the chamber without ramping, reducing the probability of damage to the cartridge and reducing the chance of a chambering stoppage. The barrel is moved to a position and at such an angle during chambering that the cartridge is moved directly forward into the chamber, and then the barrel with the cartridge is moved into alignment with the moveable bolt for firing.

4 Claims, 4 Drawing Sheets

CARTRIDGE NON-RAMPING FEED MECHANISM FOR FIREARMS

BACKGROUND OF INVENTION

Grenade launchers fire all kinds of grenade cartridges. Some are chemical, which dispense tear gas or nausea gas. Others fire flares for signalling, marking rounds with smoke, phosphorus for lighting fires, and regular high explosive for anti-personnel and armor piercing purposes.

Development of magazine fed grenade launchers has been hindered by the short, large diameter, blunt nosed cartridges used in grenade launchers. Gun mechanisms used with magazine fed grenade launchers have been necessarily long, or complex in order to provide reliable ramping of the grenade cartridge toward the chamber. Ramping, in prior art gun mechanisms is the movement of the cartridge on an angled surface provided in the weapon mechanism for guiding the cartridge from its position in a cartridge magazine into the chamber of the weapon. Most prior mechanisms provide marginal round control, permitting significant random movement of the cartridge during chambering because there is a portion of the chambering event in which neither the magazine, nor the ramp nor, nor the chamber closely guides the cartridge. The chambering ramp also provides opportunity for the nose of the projectile, or base of the cartridge case to escape from the desired path during attempting chambering, causing a weapon stoppage.

SUMMARY OF THE PRESENT INVENTION

The present invention is applied to a semiautomatic grenade launcher in which the rear of the barrel displaces downwardly at an angle, directly in front of, and coaxially with the top cartridge in the magazine for chambering. After the cartridge is nearly completely chambered by the forwardly moving rammer and bolt, then the rear of the barrel, with the cartridge, is raised to firing position in front of the bolt. Operation and control of this upward and downward barrel motion is provided by a bolt carrier connected to the barrel through a pivoted lever, actuated by a switch.

DETAILED DESCRIPTION OF ILLUSTRATIVE EMBODIMENT

Figure 1:
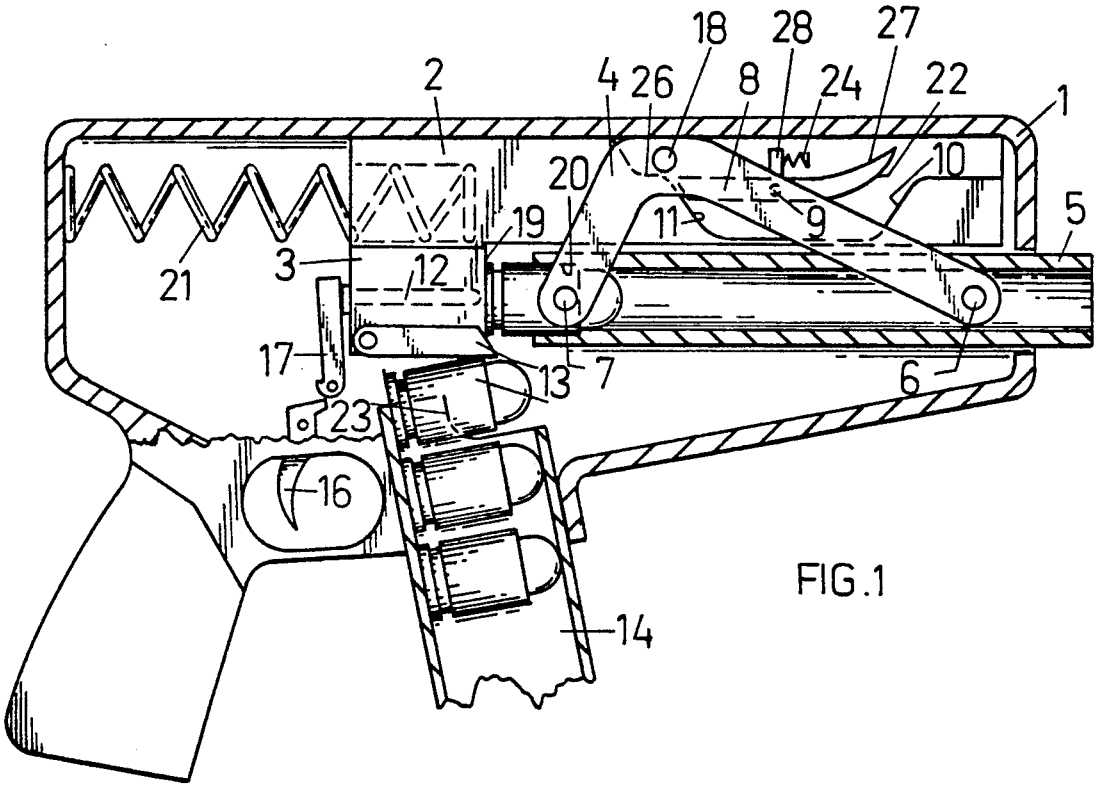
FIG. 1 is a side elevational view with the parts broken away to show the feed mechanism with the operating parts in the battery position, with a cartridge in the chamber and cartridges in the magazine. The hammer has fallen and the weapon is at the instant of firing before the projectile has started to move. To the right is toward the front.

Referring now to FIG. 1 there is a frame 1 housing a magazine 14 containing a plurality of cartridges 15. The cartridges 15 are stacked vertically in the magazine 14 with their axes parallel to each other and nose forward. They are spring urged upward.

Figure 2:
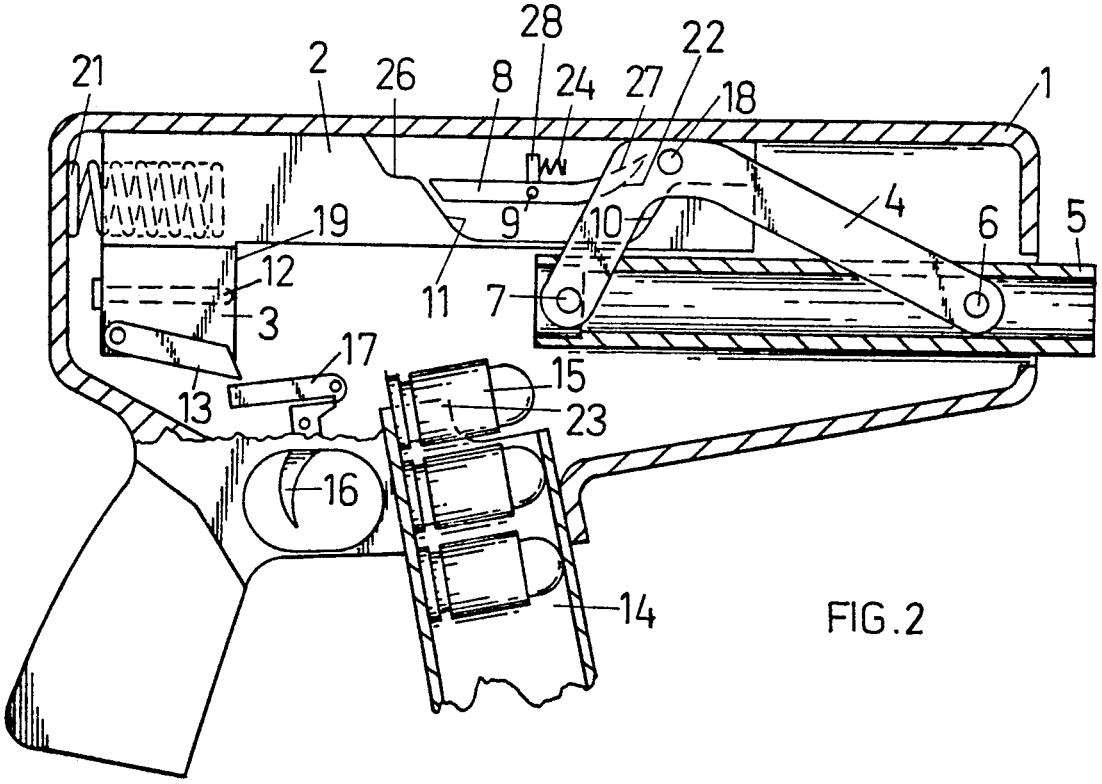
FIG. 2 is a side elevational view with the parts broken away to show the feed mechanism with the operating parts in the full recoil position after firing, with a cartridge in the magazine prepared for chambering from the magazine.

Mounted on the frame 1 by means of the barrel lever pivot 6 is a barrel lever 4 with the barrel lever lug 18 and the mounting hole for the barrel trunnion 7. By means of the front cam 10 and rear cam 11 and switch 8, the chamber 20 of barrel 5 is moved down and then up as the bolt carrier 2 with attached bolt 3 moves forward from its rearmost position in the frame 1. In FIG. 1. the barrel lever lug 18 is in the upper straight portion 26 of the rear cam 11. When the weapon is fired, the bolt carrier 2 with attached bolt 3 and including the switch 2, which is pivotally mounted to the bolt carrier 2 at switch pivot 9, which all move rearward as a unit. The bolt carrier 2 moves rearward relative to the barrel lever lug 18, which remains stationary at this time relative to the frame 1. This relative motion between the bolt carrier 2 and the barrel lever lug 18, causes the switch 8 to move rearward relative to the barrel lever lug 18. The flat portion of switch 8 is moving rearward below, but not in contact with, the barrel lever lug 18. When the bolt carrier 2 has moved far enough for the upper curved portion 27 of switch 8 to contact the barrel lug 18, the barrel lug 18 forces the switch 8 to pivot on switch pivot 9 to permit the switch 8 to pass behind the barrel lever lug 18. The switch 8 is positioned as shown in FIG. 1 and FIG. 2 by switch spring 24 pressing against switch extension 28. Switch spring 24, and the switch extension 28 of the switch 8, which the switch spring 24 bears against are not on the same plane (see FIGS. 4 & 6). There is no interference of the switch extension 28 and switch spring 24 with the bolt carrier 2 or barrel lever lug 18. Only parts of the bolt carrier 2 and the switch 8, exclusive of the switch extension 28, interact with the barrel lever lug 18. When the bolt carrier 2, in its rearmost position as shown in FIG. 2, moves forward, the front curved surface 22 of the switch 8 will contact the barrel lever lug 18. In FIG. 1. the front of the spring loaded rammer 13 has been forced to its fully upward position in the bolt 3 by the topmost of cartridges 15 in the magazine 14. The topmost cartridge of cartridges 15 does not rest against the bottom of the bolt 3. As the bolt carrier 2 with bolt 3 moves rearward (from the position shown in FIG. 1. to the position shown in FIG. 2.) in the frame 1 during recoil, the spring loaded rammer 13 is urged downwardly by its spring. When the spring loaded rammer 13 moves behind the topmost cartridge of cartridges 15 in the magazine 14, the spring loaded rammer 13 is urged fully down so that the topmost cartridge of cartridges 15 is in the path of the spring loaded rammer 13 when the bolt 3 moves forward as shown in FIG. 3.

Referring to FIG. 2, the face of bolt 19 is positioned in full recoil behind the rear of the topmost cartridge of cartridges 15 in the magazine 14. The topmost cartridge of cartridges 15 is in the path of the spring loaded rammer 13. The front curved surface 22 of switch 8 in the bolt carrier 2 is positioned behind the barrel lug 18. The front of the switch 8, was previously depressed by the barrel lever lug 18 during rearward movement of the bolt carrier 2. Now the switch 8 has been returned by its switch spring 24 to the position shown in the bolt carrier 2, after passing barrel lug 18. The hammer 17 has been forced to its cocked position by the rearward motion of the bolt 3. After this, when the bolt carrier 2 is urged forwardly by the drive spring 21 (which was compressed during recoil) the front curved portion 22 of the switch 8 will contact the barrel lever lug 18. The front curved portion 22 of switch 8 will displace the barrel lever lug 18 downwardly pivoting the barrel lever 4 about the barrel lever pivot 6. This will move the chamber 20 of the barrel 5 into coaxial alignment with the topmost cartridge of cartridges 15 in the magazine.

Figure 3:
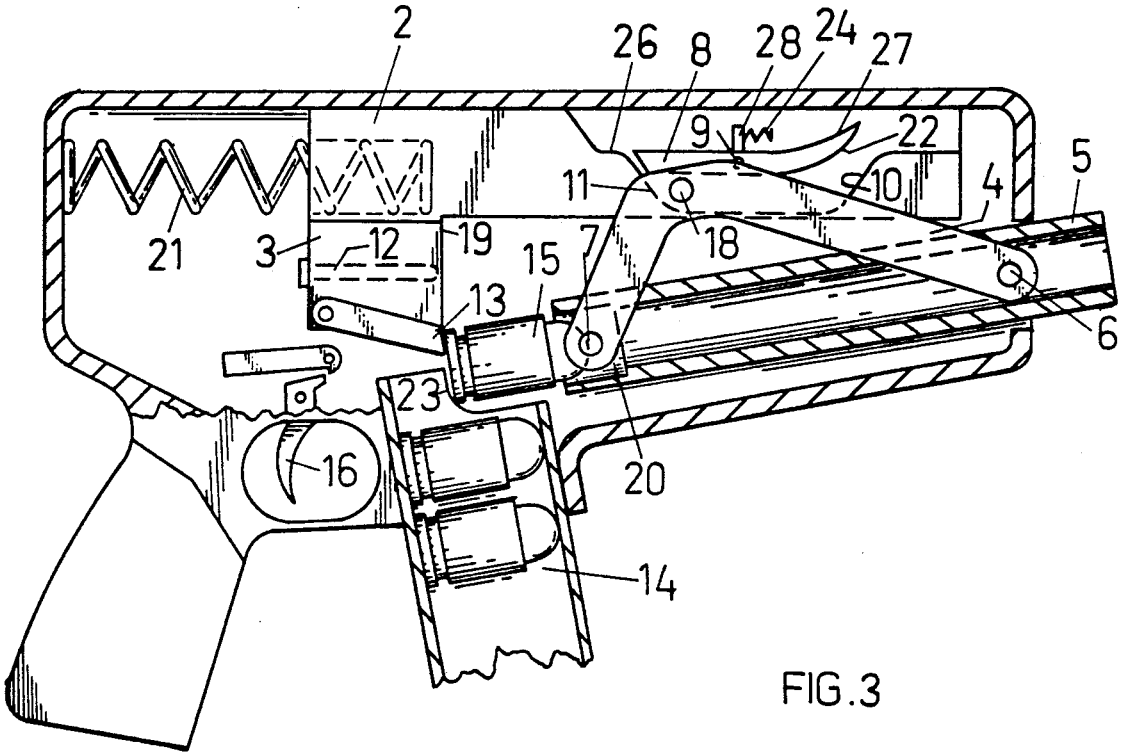
FIG. 3 is a side elevational view with the operating parts broken away to show the operating parts moving forwardly carrying the round from the magazine into the chamber of the barrel.

Referring to FIG. 3, the chamber 20 of the barrel 5, mounted to the barrel lever 4 by the barrel trunnion 7, has been forced down by the barrel lever lug 18. The barrel lever lug 18 has been forced down by the switch 8. With the chamber 20 of the barrel 5 so disposed, the axis of the chamber 20 is aligned with the axis of the topmost cartridge 15 in the magazine 14. As the bolt carrier 2 with the attached bolt 3 moves forwardly, being urged by the expanding drive spring 21, the spring loaded rammer 13 contacts the base of the topmost cartridge in the magazine carrying the cartridge 15 forwardly. The magazine 14 is mounted at an angle which causes the topmost cartridge of cartridges 15 in the magazine 14 to be co-axial with the of the chamber 20 of the barrel 5. As the topmost cartridge 15 is moved forwardly by the spring loaded rammer 13, the topmost cartridge of cartridges 15 is directly transferred into the chamber 20 without ramping, and while keeping the chambering cartridge 15 (formerly the topmost cartridge of cartridges 15 in the magazine) under positive control. Positive control of chambering cartridge 15 is first provided by the magazine feed lips 23, then positive control is provided by the magazine feed lips 23 plus the barrel 5. Then finally, complete control of the chambering cartridge 15 is transferred to the chamber 20 of the barrel 5. The base of the chambering cartridge 15, being pushed by spring loaded rammer 13 moves out of the magazine feed lips 23, and then chambering cartridge 15 is in complete axial control of the chamber 20 of the barrel 5. At this point the barrel lever lug 18 is contacted by the rear cam 11 of the bolt carrier 2. The rear cam 11 forces the barrel lever lug 18 upwardly bringing the barrel lever 4, along with the barrel trunnion 7, and chamber 20 of the barrel 5, containing the chambering cartridge 15. As the bolt carrier 2 continues forward, the rear cam 11 raises the barrel lever lug 18 upwardly into contact with the switch 8, forcing the switch 8 to rotate about the switch pivot 9, permitting the barrel lever lug 18 to move to its fully raised position. As the bolt carrier 2, with its switch 8 continues forward, the switch 8 moves out of contact with the barrel lever lug 18. The switch spring 24 returns the switch 8 to its position illustrated in FIG. 1. The mechanism has returned to the condition illustrated in FIG. 1., except the hammer 17 remains cocked until the trigger 16 is pulled to fire the next round.

Figure 4:
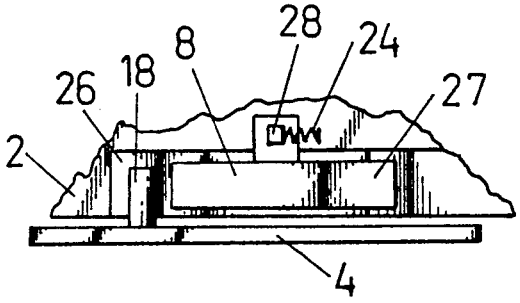
FIG. 4 is a plan view showing selected parts of the mechanism.
Figure 5:
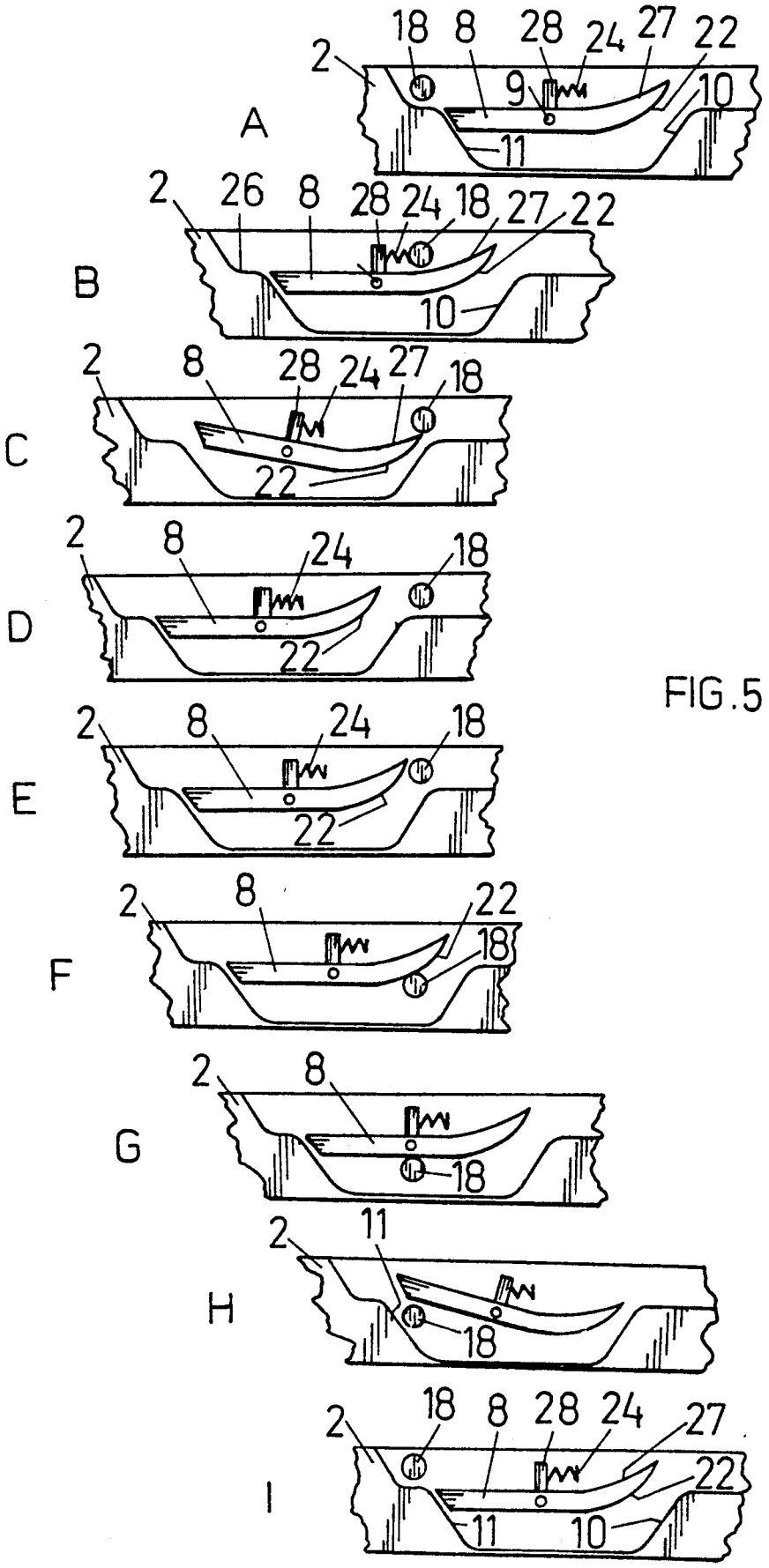
FIG. 5 is an elevational view illustrating selected parts at progressive stages in the operating cycle.

Referring to FIG. 4. This figure is used in conjunction with FIGS. 1. through 3. and FIGS 5 and 6 to clarify operation. Referring to FIG. 5. This Figure illustrates selected parts of the mechanism progressively through the stages of the operating cycle.

In view A. the bolt carrier 2 is in its fully forward position, as it would be when ready for firing. The barrel lever lug 18 (shown without the barrel lever for clarity) is shown in all views as barrel lever lug 18 is actuated by the bolt carrier 2 and the switch 8. The barrel lever 4 (not shown) and the barrel 5 (also not shown) therewith are actuated by the barrel lever lug 18.

In view B. the bolt carrier 2 is moving rearwardly, carrying the switch 8, switch extension 28, and switch spring 24 with the bolt carrier 2. The switch 8 is moving rearwardly under, but not in contact with the barrel lever lug 18. The switch spring 24 is not on the same plane (see FIG. 4.) as the barrel lever lug 18.

In view C. the bolt carrier 2 is continuing to move rearwardly, with the rear curved surface 27 of switch 8 being engaged by, and being rotated downwardly by the barrel lever lug 18 while the upper curved surface 27 of the switch 8 passes behind the barrel lever lug 18.

In view D. the bolt carrier 2 with switch 8 has moved fully rearward in recoil. The switch 8 has moved behind, and disengaged from barrel lever lug 18, and switch spring 24 has returned switch 8 to its original position relative to the bolt carrier 2.

In view E. the bolt carrier 2 is moving forwardly and the barrel lever lug 18 is just contacting the front curved surface 22 of switch 8.

In view F. the bolt carrier 2 is carrying the switch 8 forwardly, and the barrel lever lug 18 is being forced downwardly by the front curved surface 22 of the switch 8.

In view G. the barrel lever lug 18 has been forced by the switch 8 to its lowermost position. The bolt carrier 2 with switch 8 are moving forwardly while the barrel lever lug 18 remains stationary relative to the bolt carrier 2.

In view H. the rear cam 11 of the bolt carrier 2 has contacted, and is rotating upwardly, the barrel lever lug 18. The switch 8 is being rotated by the barrel lever lug 18, permitting the barrel lever lug 18 to move upwardly relative to the bolt carrier 2.

In view I. the operating cycle has been completed and the parts have returned to the same condition as in view A.

Figure 6:
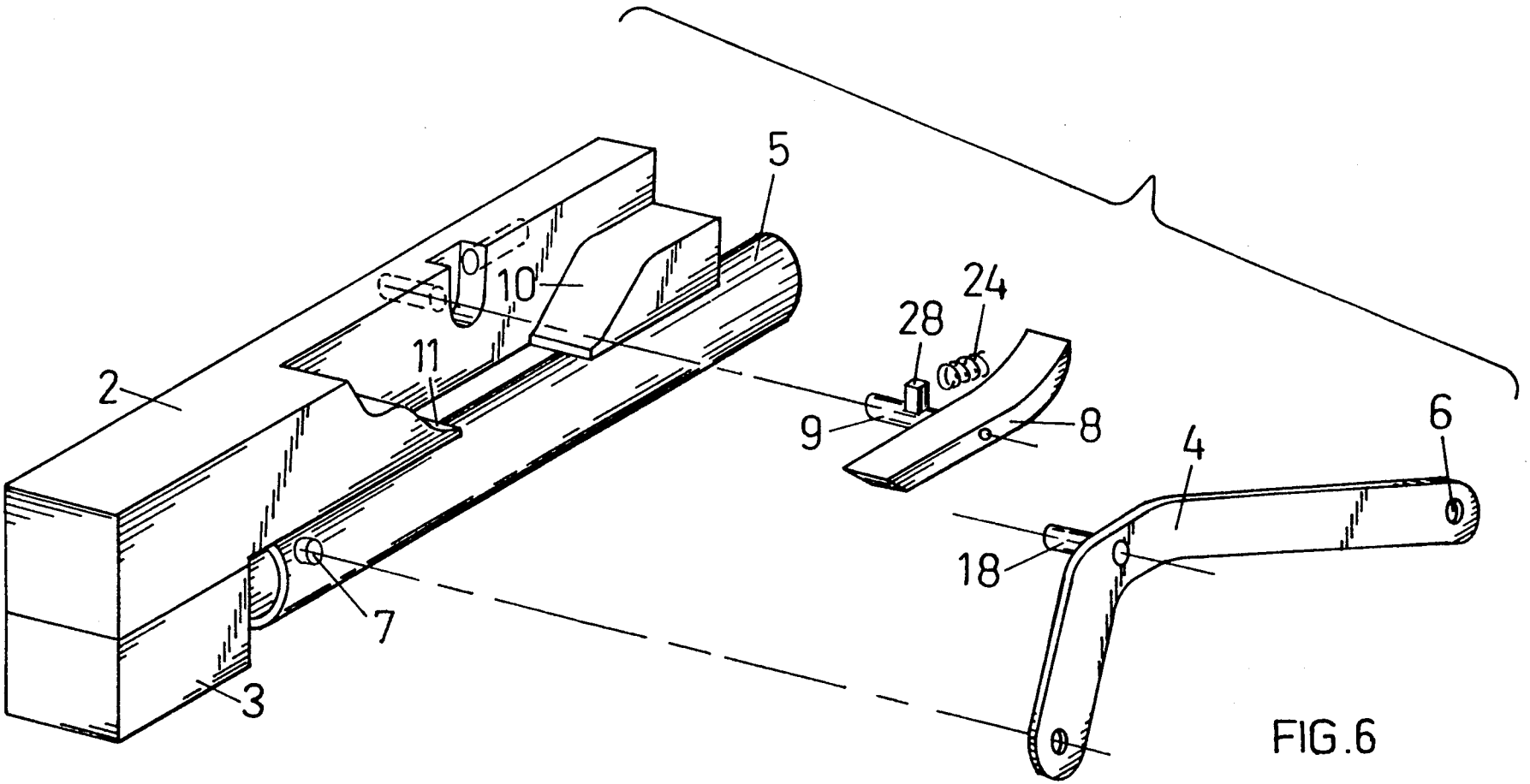
FIG. 6 is an exploded perspective view showing the relationships of selected critical parts.

Referring to FIG. 6. This figure is used in conjunction with the other figures to illustrate the configurations of principal parts of the invention and their relationships with each other.

Having described the preferred embodiment wherein the present invention is used, it is to be understood variations, improvements and modifications may be made without departing from the spirit of the invention, and that such deviations and alterations are to be considered as part of the present invention as set forth in the following claims.

What is claimed is:

1. A firearm mechanism for non-ramping chambering the top cartridge in a magazine, said mechanism comprising:

a firearm frame, a barrel having a chamber at its rearmost end, a bolt carrier and bolt, a spring loaded cartridge rammer, a switch, and a barrel lever, said frame having a barrel lever pivot by which said barrel lever is pivotally attached to said frame, said barrel lever being attached to said barrel for pivotal movement of said barrel in said frame, said bolt carrier and bolt moving forwardly and rearwardly within said frame, said switch being pivotally mounted on said bolt carrier and moveable therewith, said barrel lever having a lug engageable with said switch for actuation of said switch and actuation by said switch, said lug also being engageable with said bolt carrier for movement of said barrel lever, said barrel lever positioning said chamber coaxially and in front of the top cartridge in said magazine for non-ramping chambering said cartridge, said barrel lever realigning said chamber with said bolt for firing.

2. A firearm mechanism as in claim 1 wherein said bolt carrier has a rear cam surface having a path of movement to engage said barrel lever lug causing upward movement of said lug and thereby raising said chamber for realignment with said bolt.

3. A firearm mechanism as set forth in claim 1 wherein said switch has a straight upper portion which moves under said barrel lever lug without contact therewith, such that when said bolt and bolt carrier moves said switch rearwardly, said switch having a raised surface engageable with said lug for rotation of said switch to permit said switch passage rearwardly behind said lug, said switch having a sloped surface engageable with said lug on forward movement of said switch, thereby depressing said lug which depresses said barrel level and in turn said chamber.

4. A firearm mechanism as in claim 3 wherein said switch has a switch pivot connected to said bolt carrier, said switch having a rearward projection extending from said switch pivot, said rearward projection being engageable with said lug as said bolt carrier moves forwardly and raising said chamber to alignment with said bolt for firing.

* * * * *